United States Patent [19]

Thörner

[11] Patent Number: 4,993,608

[45] Date of Patent: Feb. 19, 1991

[54] POURING TUBE FOR THE INTRODUCTION OF METALLIC MELT INTO A STRIP-CASTING MOLD

[75] Inventor: Hans-Otto Thörner, Meerbusch, Fed. Rep. of Germany

[73] Assignee: SMS Schloemann-Siemag Aktiengesellschaft, Dusseldorf, Fed. Rep. of Germany

[21] Appl. No.: 333,244

[22] Filed: Apr. 3, 1989

[30] Foreign Application Priority Data

Apr. 8, 1988 [DE] Fed. Rep. of Germany ..... 3811751

[51] Int. Cl.[5] ..... B22D 41/50

[52] U.S. Cl. ..... 222/607; 164/437

[58] Field of Search ..... 164/437; 222/606, 607, 222/594

[56] References Cited

U.S. PATENT DOCUMENTS

| | | | |
|---|---|---|---|
| 3,371,704 | 3/1968 | Astrov et al. | 164/437 |
| 3,578,064 | 5/1971 | Mills et al. | 164/437 |
| 3,995,682 | 12/1976 | Fekete et al. | 164/437 |
| 4,662,546 | 5/1987 | Mosser et al. | 164/437 X |
| 4,819,840 | 4/1989 | Lax et al. | 164/437 X |

FOREIGN PATENT DOCUMENTS

| | | | |
|---|---|---|---|
| 53-26209 | 8/1978 | Japan | 164/437 |
| 61-226149 | 10/1986 | Japan | 164/437 |
| 893392 | 12/1981 | U.S.S.R. | 222/594 |
| 1194571 | 11/1985 | U.S.S.R. | 164/437 |

*Primary Examiner*—Richard K. Seidel
*Assistant Examiner*—J. Reed Batten, Jr.
*Attorney, Agent, or Firm*—Wolf, Greenfield & Sacks

[57] ABSTRACT

The pouring tube includes a discharge portion having discharge ports in its wall for splitting the flow of melt, and for directing the various portions of the flow into the surrounding melt as melt streams emerging at angles to the outer surface of the pouring tube. The angles of the streams to the pouring tube are selected such that the energy of the streams is dissipated in the surrounding melt before the streams impinge against a wall of the mold. The pouring tube also includes seals for temporarily preventing the emergence of selected streams in order to avoid excessive splashing and/or material build up on the walls of the mold during the start-up phase of its operation.

13 Claims, 2 Drawing Sheets

POURING TUBE FOR THE INTRODUCTION OF METALLIC MELT INTO A STRIP-CASTING MOLD

BACKGROUND

1. Field of the Invention

The present invention relates generally to pouring tubes for use with continuous strip-casting equipment. More particularly, the invention relates to pouring tubes which are designed for the introduction of a metallic melt into the cavity of the mold through lateral discharge ports located below the normal operational surface level of melt in the mold.

2. Summary of the Prior Art

In the continuous casting of metallic strip, particularly steel or aluminum strip, it is well understood that melt must be supplied to the cavity of the mold in sufficent quantity to allow the maintenance of efficient casting speeds. It is also well understood that the non-uniform distribution of melt within the cavity of the mold can detrimentally effect the quality of the strip being cast. The introduction of desirable quantities of melt into the cavity of the mold in a manner which maintains the required uniformity of distribution of melt within the mold, however, has heretofore presented serious problems to the art. For example, the so called "free-pouring" method has been found to be unsuitable for the continuous casting of steel strip. This method results in a melt distribution within the mold which is not uniform. Accordingly, acceptable product quality cannot be assured. Further, the "free pouring" method introduces unacceptable heat loss and re-oxidation problems in the continuous casting context.

Attempts have been made to solve this problem by introducing melt below the normal operational melt surface level in a continuous strip-casting mold. For this purpose, molds for the continuous casting of metallic strip have been developed having an enlarged pouring area which tapers inwardly and downwardly from the to of the mold centrally between the broad side walls and the narrow side walls which form the cavity of the mold. Pouring tubes for use with these molds have also been developed. These pouring tubes extend from a melt container to the mold cavity, and include a discharge portion (adjacent to their free ends) which extends into the volume of the enlarged pouring area below the normal operational melt surface level in the mold. The discharge portion of such pouring tubes is closed axially, and includes a lateral exit port facing each of the narrow side walls of the mold. The melt flows from the container through the pouring tube to its free end. At the free end of the tube, the melt is deflected outwardly through the lateral exit ports, toward the narrow side walls of the mold. The resulting melt stream flow into the melt already present in the mold cavity radially from the pouring tube toward the inner surfaces of the narrow side walls of the mold. Since the melt in each of these streams has a high kinetic energy (i.e., the flow is fast in order to assure that an adequate quantity of melt for efficient strip casting reaches the cavity of the mold), the identifiable currents created by the inflooding melt within the melt already present in the cavity extend from the pouring tube all the way to the walls of the mold. This results in erosion of the strand shell under formation along the walls of the cavity. The presence of an appropriate strand shell is important to the casting of strip having acceptable structure and a uniform, fault free surface. Hence, the damage to (and/or the impediment to the formation of) the strand shell in such prior art devices must, if possible, be strictly controlled. This means that melt introduction rates must be held below optimum levels, thus reducing the efficiency of the entire casting operation.

Similarly, since the volume of melt normally present within the cavity of the mold is not large (particularly in cases wherein strip having thin cross-sectional height, for example, less than 60 mm, is being cast), and since that volume cannot readily absorb the energy of the incoming melt streams, the streams flowing outwardly from the discharge ports towards the narrow side walls also tend to create non uniform distributions of melt within the cavity of the mold, i.e., an excess of melt (standing waves) adjacent the narrow side walls of the cavity. This excess melt is forced upwardly (adjacent the narrow side walls) because it is confined by the broad side walls, a narrow side wall, the melt below it, and the incoming stream of melt behind it. Therefore, the surface of the melt in the cavity is raised adjacent each of the narrow side walls relative to its normal level, creating a trough in the area adjacent the pouring tube. This can cause deviations from the preferred flow characteristics of the melt through the mold which are detrimental to the formation of acceptable strip. It also may cause metal to become caked on the walls of the mold above the normal level of the melt therein. In extreme cases, the energy of the streams may be great enough to cause splashing of the melt adjacent the narrow side walls of the mold. Melt splashing is particularly problematic during the start-up phase, when the melt in the cavity of the mold has not yet had a chance to reach its normal operational level.

SUMMARY OF THE INVENTION

Accordingly, it is an object of the present invention to provide a pouring tube for use with a continuous strip-casting mold having an enlarged pouring area wherein the creation of excessive melt concentrations adjacent the narrow side walls of the mold which rise above the normal operational melt surface level is avoided.

It is also an object of the present invention to provide a pouring tube for use with a continuous casting mold having an enlarged pouring area wherein erosion, and/or impediment to the formation of an appropriate strand shell is avoided.

It is further an object of this invention to provide a pouring tube for use with a continuous strip-casting mold having an enlarged pouring area wherein the splashing and/or caking-on of the melt adjacent the narrow side edges of the mold is avoided.

Still further, it is an object of the present invention to provide a pouring tube for use with a continuous strip casting mold having an enlarged pouring area which is particularly useful in the continuous casting of metallic strip having thin cross-sectional heights, in the range of about 60 mm to about 20 mm.

These and other features and objects of the invention are accomplished by the provision of improved means for introducing a metallic melt into the enlarged pouring area of a continuous strip-casting mold below the normal operational melt surface level in that mold. The improved means splits the incoming flow of melt and directs the various portions of the flow as melt streams into the melt already present within the mold cavity.

Each melt stream is directed at an angle selected such that the energy of the stream will be dissipated in the surrounding melt prior to its impingement against a wall of the mold cavity.

In a preferred embodiment of the invention, the melt is introduced through a pouring tube which includes a discharge end having opposing symmetrical groups of discharge ports respectively arranged facing the narrow side walls of the mold. Each group of discharge ports includes a central discharge port flanked circumferentially along the tube by a pair of side discharge ports. The side discharge ports are so shaped that melt streams flow therefrom into the melt already contained within the mold at an acute angle to the normal operational melt surface level in the mold. The central discharge ports, on the other hand, are so shaped that melt streams flow therefrom at angles no greater than 90 degrees to the direction of strip casting. This splitting of the melt into numerous streams directed at various angles to the pouring tube into the melt already present in the mold, results in the early dissipation of the energy of the inflowing melt and a more uniform distribution of the melt within the mold. In particular, the excess melt adjacent the narrow side walls, which was a detrimental result of the prior art constructions, is avoided. Also, erosion of the strand shell is not present with the present invention because the energy of the various melt streams is dissipated before the streams can reach the mold walls. The desired flow path of the melt through the continuous strip casting mold is also more optimally maintained than was possible in the prior art because the distribution of the melt in the mold cavity is more uniform.

It has been found that the objects of this invention may be accomplished by upwardly slanting the parallel upper and lower edges of the side discharge ports at an angle between about 50 degrees and 80 degrees to the inner surface of the pouring tube. The upper and lower parallel edges of the central discharge ports should be located at an angle no greater than 90 degrees to the direction of strip casting. It has also been found that the separation of the areas of residual stream dissipation is promoted by making the width of each of the side discharge ports smaller than the width of either of the central discharge ports. Similarly, melt throughput has been found to be improved when the height of each discharge port is made to be at least twice its width. In the case of a pouring tube having an oval cross section, the preferred location of the discharge port groups is in those portions of the wall of the discharge portion of the pouring tube which have the greatest curvature.

Still further, it has been found that there may be instances when it is desirable to temporarily block the flow of melt through the side discharge ports. One such instance is during the start-up of the continuous strip casting mold in order to avoid splashing of the incoming melt against, and the baking of the splashes on, the walls of the cavity of the mold prior to the melt reaching its normal operating level. To accomplish this, the side discharge ports may be sealed with any suitable limited life seal. Such limited life seals may be melt-on seals having a service life of between approximately 5 seconds and 30 seconds. The pouring tube of the present invention is particularly useful for steel or aluminum continuous strip casting. Melt-on seals of the same type of material as that being cast, but with a lower melting point, have been found to be especially advantageous. The use of such seals allows the start-up of continuous strip casting without excessive splashing of the melt against the walls of the cavity of the mold, but once the melt fills the mold to a level above the top of the discharge ports, the seals will dissolve in the surrounding hot melt. This automatically frees the side discharge ports and allows the energy dissipating function of the present invention to operate without restriction.

BRIEF DESCRIPTION OF THE DRAWINGS

The invention will be best understood by reference to the following detailed description of its preferred embodiments and with reference to the attached drawings in which.

DETAILED DESCRIPTION OF PREFERRED EMBODIMENTS

Figure 1:
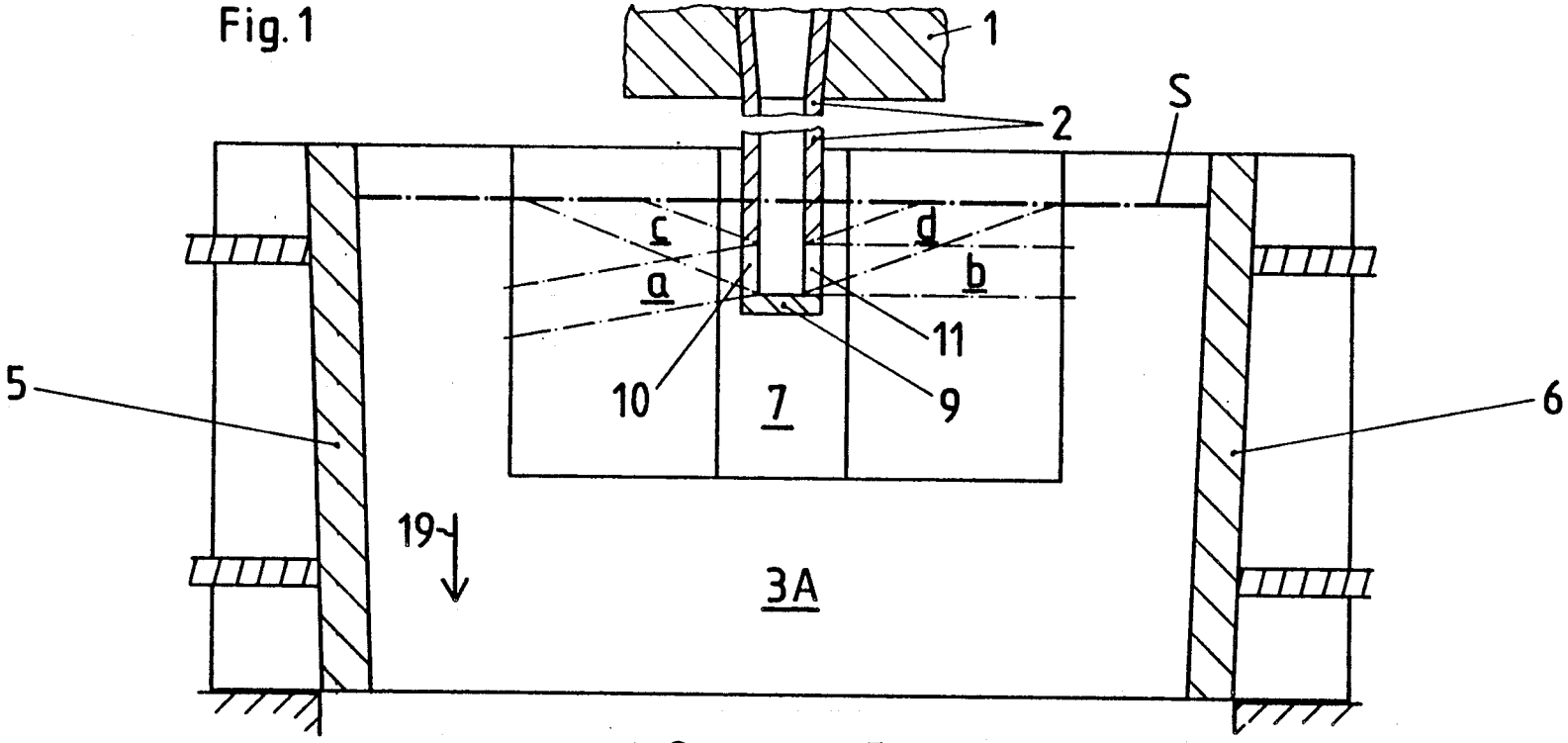
FIG. 1 is a diagrammatic cross sectional side view of a continuous strip-casting mold showing a pouring tube in accordance with the present invention inserted into its pouring area and also showing (in dashed and dotted lines) illustrative locations and extents of the various melt streams flowing from the pouring tube.

Referring now to the drawings, and particularly to FIG. 1, there is shown diagrammatically an apparatus for the continuous casting of metallic strip. The container 1 contains a reservoir of metallic melt. In communication with the reservoir, a pouring tube 2 extends from the underside of the container 1 to a continuous strip-casting mold. The mold includes a pair of cooled, broad side walls 3 and 4 separated by a pair of narrow side walls 5 and 6 forming the cavity of the mold. Narrow side walls 5 and 6 may be adjustable relative to the broad side walls. The mold also includes an enlarged pouring area 7 which tapers inwardly and downwardly from the top of the mold centrally between the broad side walls and the narrow side walls above the strip forming area 3A of the mold. Pouring area 7 in the exemplary embodiment shown in FIG. 1 extends only partially over the height of the mold. The pouring area could extend over all, or any portion of, the mold height, without departure from the present invention, as long as the dimensions of the pouring area remain adequate for the insertion of the discharge portion of the pouring tube therein to a point below the normal operational melt surface level (S) in the cavity of the mold.

The discharge portion of the pouring tube 2 is located adjacent its free end. It includes a stop plate 9 axially closing the free end of the tube, and opposing symmetrical groups of discharge ports 10, 12 and 11, 13, respectively, in the wall of the pouring tube adjacent the free end. Each group of discharge ports includes a central discharge port 10 or 11 flanked circumferentially along the wall of the tube by a pair of side exit ports 12 or 13. The entire discharge portion of the tube is inserted into the volume defined by the pouring area 7 to a depth such that all of the exit ports are located below the normal operational melt surface level (S) within the cavity of the mold during casting operations. The discharge portion is also oriented relative to the mold cavity such that the opposing central discharge ports 10 and 11 face the narrow side walls 5 and 6 of the mold cavity. The pouring tube may have substantially any cross-sectional shape desired, but it has been found that either a circular or an oval cross section are particularly advantageous. In the case of the selection of an oval cross section, the groups of discharge ports preferably are located in the portions of the wall of the tube having the greatest curvature.

The discharge ports are generally rectangular, and the central discharge ports 10 and 11 have a greater cross-sectional area than side discharge ports 12 and 13. Each of the discharge ports 10, 11, 12, and 13 also preferably has a height greater than twice its width. Further, central discharge ports 10 and 11 have parallel upper and lower walls 16 and 17 located at an angle no greater than 90 degrees to the direction of strip casting. Side discharge ports 12 and 13, on the other hand, have parallel upper and lower walls 14 and 15 are slanted upwardly toward the normal operational melt surface level at an angle between about 50 degrees and about 80 degrees to the inner surface of the portion of the pouring tube.

Figure 2:
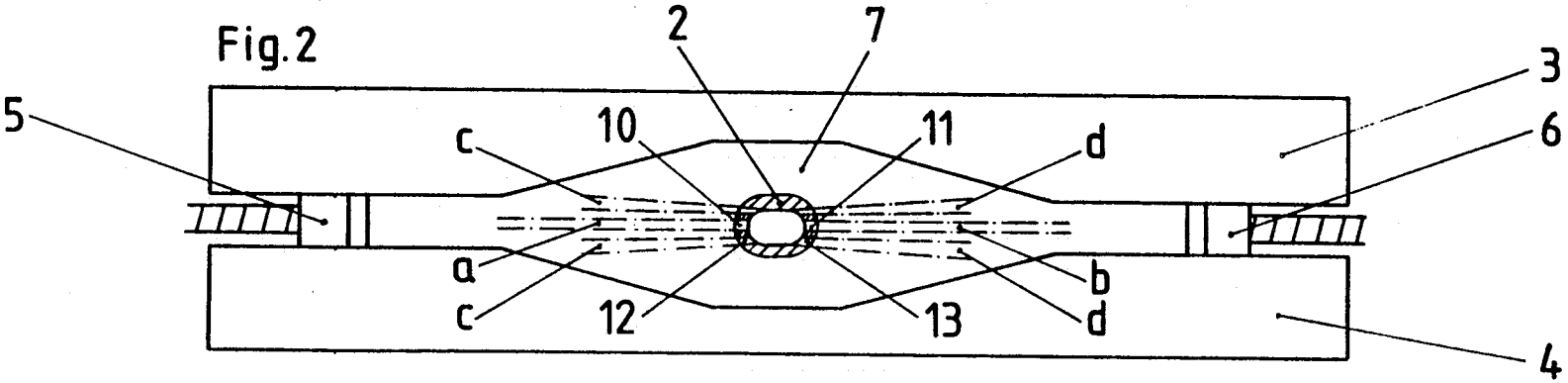
FIG. 2 is a top view of the continuous strip-casting mold and pouring tube of FIG. 1, wherein the pouring tube is shown in section through its discharge portion and the melt streams flowing from the pouring tube are shown in dashed and dotted lines.
Figure 3:
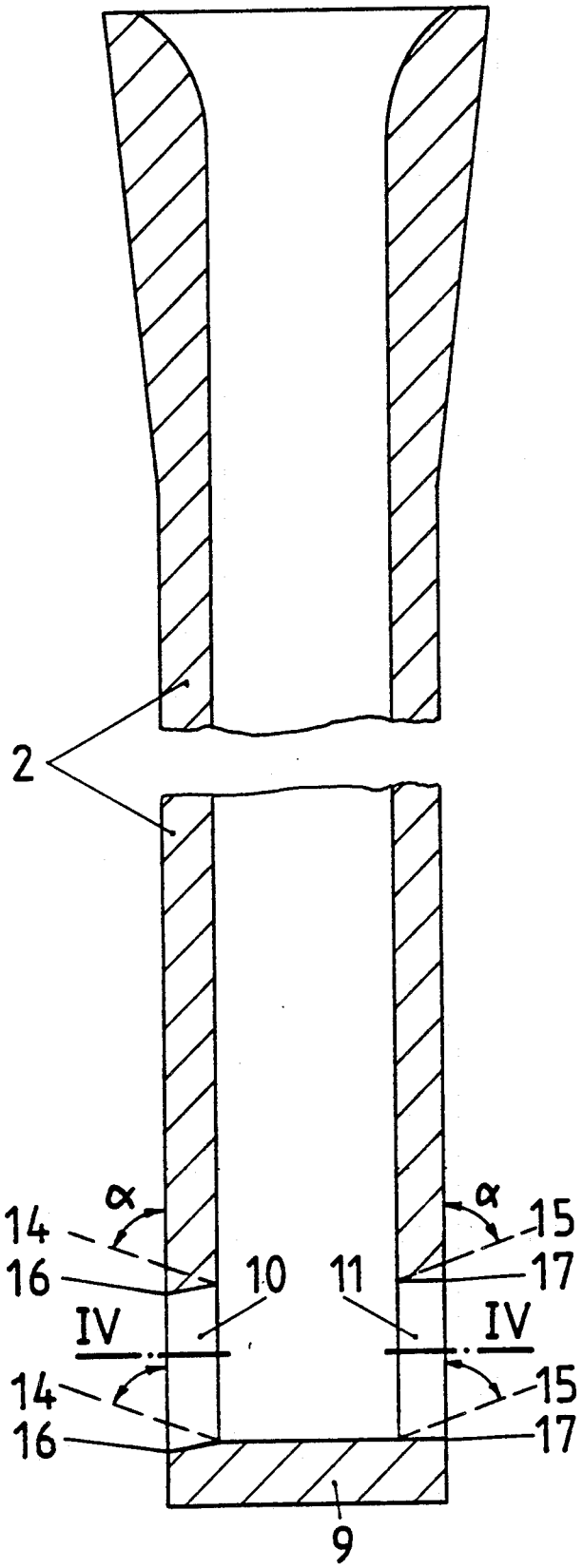
FIG. 3 is a sectional side view of a pouring tube in accordance with the present invention.
Figure 4:
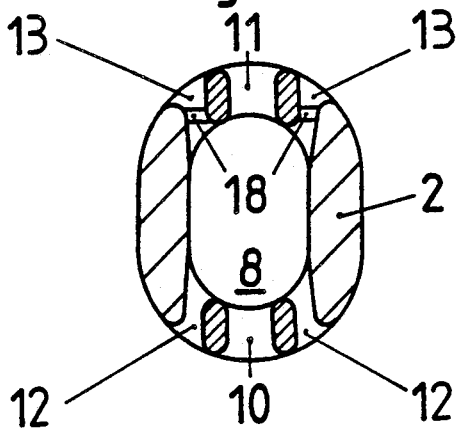
FIG. 4 is a cross sectional view of the pouring tube of FIG. 3 taken along the line IV—IV.
Figure 5:
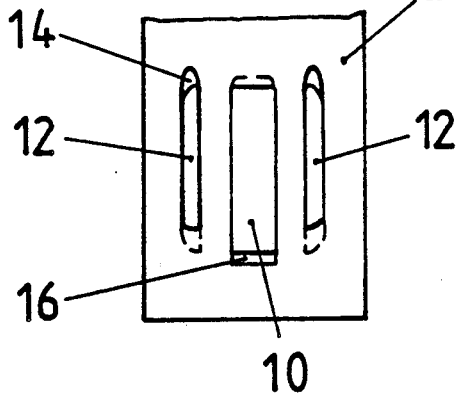
FIG. 5 is a side view of the discharge portion of a pouring tube in accordance with the present invention showing a group of discharge ports; and, FIG. 6 is a side view of the discharge portion of another pouring tube in accordance with the present invention showing an alternatively-shaped group of discharge ports.
Figure 6:
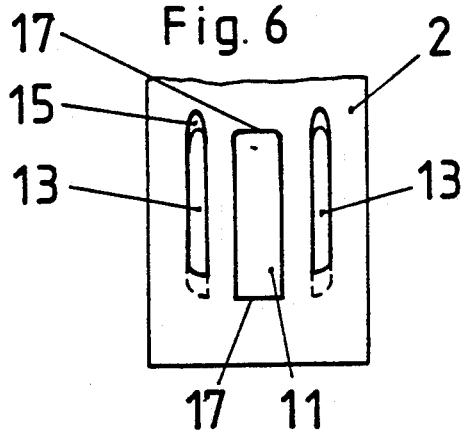

During operation, the melt flows through the pouring tube 2 in cavity 8 to the stop plate 9 where it is deflected outwardly through discharge ports 10, 11, 12, and 13, in the form of six separate and distinct streams of melt within the melt already present in the mold. The directions of these melt streams are shown diagrammatically in FIGS. 1 and 2. The melt flowing through side discharge ports 12 and 13 is deflected upwardly toward the normal operational melt surface level (S) in the mold cavity (see melt stream paths c and d). The melt flowing through both of the central discharge ports, on the other hand, flows either radially outwardly from the pouring tube toward the narrow side walls of the mold (shown representatively as melt stream path b), or at an acute angle to the direction 19 of flow of melt through the mold (shown representatively as melt stream path a). This division of the incoming melt as it flows from the pouring tube into the cavity of the mold below the normal operational melt surface level, combined with the directional deflection of each melt stream, results in a optimally uniform distribution of the melt within the mold during the casting operation. Also, the energy of melt streams a and b is dissipated prior to reaching the narrow side walls 5 and 6 of the mold, usually within the pouring area 7. This prevents a rise in the level of the surface of the melt in the cavity adjacent the side walls which was found to be detrimental in the prior art. Similarly, since melt streams c and d are of smaller cross section than melt streams a and b, their energy is smaller than that of streams a and b. The upward deflection of melt paths c and d allows them to be dissipated in the melt present in the mold, normally within the pouring area 7, and, in any case, prior to reaching a wall of the mold cavity and causing any significant erosion of (or impediment to the formation of) the strand shell.

The upward deflection of melt streams c and d from the side discharge ports may cause significant problems during start-up of the mold. Splashing and baking of the melt onto mold walls 3, 4, 5, and 6 are particularly troublesome in this regard. The present invention therefore may include limited service-life seals 18 closing side discharge ports 12 and 13 during the start up phase of the casting operation. It has been found that melt-on seals made of the same type of metal as that being cast, but having a lower melting point, are particularly useful for this purpose. Normally, the melt will fill the mold to a level above the top edges of the discharge ports within five to ten seconds after the start of melt flow through the pouring tube. By selecting the thickness of the melt on seal appropriately, the side discharge ports may be automatically freed, after the melt covers the ports, by the dissolving of the seal material in the hot melt, without adverse effect upon the strip being cast.

Numerous modifications, adaptations, adjustments, additions, and variations upon the present invention will occur to those skilled in the art in view of the foregoing detailed description of a preferred embodiment of this invention. It should accordingly be understood that the foregoing specification and the attached drawings are intended to be illustrative only and not limiting. The attached claims set forth the only limiting parameters by which it is intended to limit this invention.

What is claimed:

1. Apparatus for providing metallic melt from a melt source to maintain a predetermined melt level in a strip casting mold which processes a continuous stream of melt in a strip-casting direction into a cast strip, said mold having a funnel-shaped pouring area formed of an opposing pair of broad side walls, at least a portion of said broad side walls tapering towards each other in a downstream direction and an opposing pair of narrow side walls, said mold further having a strip casting area located downstream of said pouring area, said apparatus comprising:

tubular pouring means for conveying said melt stream to said mold pouring area, said pouring means having:

a first axial end connected to said melt source;

a second, closed axial end positioned below said predetermined melt level;

an oval cross section with a wall having sections of a first curvature and sections of a second curvature greater than said first curvature; and opposing symmetrical groups of discharge ports located adjacent to said second axial end and extending through said wall sections with said second curvature, each of said groups of discharge ports including a central discharge port circumferentially flanked by a pair of side discharge ports, said pouring means being oriented in said pouring area so that said groups of discharge ports face said opposing narrow mold side walls whereby said groups of discharge ports split said melt stream into a plurality of separate melt substreams which flow away from said puring means with kinetic energy towards said narrow mold side walls and said energy of each of said plurality of melt substreams is dissipated within said pouring area before said each substream impinges against any of said mold side walls.

2. The apparatus of claim 1, wherein each said central discharge port is adapted to deliver a melt substream to said pouring area at an angle no greater than 90 degrees to said strip casting direction.

3. The apparatus of claim 2, wherein each said side port is adapted to deliver a melt substream to said pouring area at an acute angle upwards toward said predetermined melt level.

4. The apparatus of claim 3, wherein said pouring means has an inner surface parallel to said strip-casting direction and each said side discharge port includes parallel top and bottom walls slanted upwardly at an angle between about 50 degrees and about 80 degrees to said pouring means inner surface.

5. The apparatus of claim 2, or claim 3, or claim 4, wherein said each central discharge port has a height and a width and the width of said each central discharge port is greater than the width of said each side discharge port.

6. The apparatus of claim 2, or claim 3, or claim 4, wherein each of said discharge ports has a height and a width and the height of each of said discharge ports is at least twice as great as the width of each of said discharge ports.

7. The apparatus of claim 2, or claim 3, or claim 4, wherein the width of said central discharge ports is greater than the width of said side discharge ports, and wherein the height of each of said discharge ports is greater than the width of each of said discharge ports.

8. Apparatus for providing metallic melt from a melt source to maintain a predetermined melt level in a strip casting mold which processes a continuous stream of melt in a strip-casting direction into a cast strip, said mold having a funnel-shaped pouring area formed of an opposing pair of broad side walls, at least a portion of said broad side walls tapering towards each other in a downstream direction and an opposing pair of narrow side walls, said mold further having a strip casting area located downstream of said pouring area, said apparatus comprising:

tubular pouring means for conveying said melt stream to said mold pouring area, said pouring means having:

a first axial end connected to said melt source;

a second, closed axial end positioned below said predetermined melt level;

opposing symmetrical groups of discharge ports located adjacent to said second axial end, each of said groups of discharge ports including a central discharge port circumferentially flanked by a pair of side discharge ports, said side discharge ports being closed by seals having a limited service life, said pouring means being oriented in said pouring area so that said groups of discharge ports face said opposing narrow mold side walls whereby said groups of discharge ports split said melt stream into a plurality of separate melt substreams which flow away from said pouring means with kinetic energy towards said narrow mold side walls and said energy of each of said plurality of melt substreams is dissipated within said pouring area before said each substream impinges against any of said mold side walls.

9. The apparatus of claim 8, wherein said seals are melt-on seals.

10. The apparatus of claim 8 or claim 9, wherein said seals have a service life of between about five seconds and about thirty seconds.

11. The apparatus of claim 9, wherein said seals comprise a metal of the same type, but having a lower melting point than, the metal being cast in said casting mold.

12. The apparatus of claim 11, wherein the metal is steel.

13. The apparatus of claim 11, wherein the metal is aluminum.

* * * * *